US011123886B1

(12) United States Patent
Park

(10) Patent No.: US 11,123,886 B1
(45) Date of Patent: Sep. 21, 2021

(54) KNIFE ATTACHMENT TO PREVENT FOOD FROM STICKING

(71) Applicant: Eun Ah Park, Flushing, NY (US)

(72) Inventor: Eun Ah Park, Flushing, NY (US)

( * ) Notice: Subject to any disclaimer, the term of this patent is extended or adjusted under 35 U.S.C. 154(b) by 4 days.

(21) Appl. No.: 16/820,906

(22) Filed: Mar. 17, 2020

(51) Int. Cl.

| | |
|---|---|
| ***B26B 11/00*** | (2006.01) |
| ***B26B 3/00*** | (2006.01) |
| ***B26B 9/00*** | (2006.01) |
| ***B26D 7/18*** | (2006.01) |

(52) U.S. Cl.
CPC ..... *B26B 11/006* (2013.01); *B26B 3/00* (2013.01); *B26B 9/00* (2013.01); *B26D 7/18* (2013.01)

(58) Field of Classification Search
CPC ..... B26D 2007/1809
See application file for complete search history.

(56) References Cited

U.S. PATENT DOCUMENTS

| | | | | |
|---|---|---|---|---|
| 2,178,267 | A | 10/1939 | Potstada | |
| D710,657 | S | 8/2014 | Chen | |
| 9,446,532 | B2 | 9/2016 | Nasrallah | |
| 2008/0201863 | A1 | 8/2008 | Yang | |
| 2010/0307008 | A1* | 12/2010 | Zeitlin | B26B 29/02 30/128 |
| 2012/0159793 | A1* | 6/2012 | Hatch | B26B 29/02 30/312 |
| 2012/0198707 | A1 | 8/2012 | Blacken | |
| 2014/0317940 | A1 | 10/2014 | Scobie | |
| 2015/0328781 | A1 | 11/2015 | Chen | |
| 2015/0375470 | A1* | 12/2015 | Kim | B32B 15/20 428/99 |
| 2016/0031111 | A1* | 2/2016 | Nasrallah | B26B 11/00 30/128 |

FOREIGN PATENT DOCUMENTS

| | | | |
|---|---|---|---|
| JP | 2002000970 A | * | 1/2002 |
| JP | 2011147586 A | * | 8/2011 |
| KR | 101153208 B1 | * | 6/2012 |
| WO | 2008070594 | | 6/2008 |

OTHER PUBLICATIONS

English translation of JP 2002000970A, Jan. 2002.*

* cited by examiner

*Primary Examiner* — Hwei-Siu C Payer

(57) ABSTRACT

The knife attachment to prevent food from sticking is configured for use with a knife blade. The knife attachment to prevent food from sticking is a non-stick structure. A first instantiation of the knife attachment to prevent food from sticking attaches to the face of the blade with the greatest surface area. An optional second instantiation of the knife attachment to prevent food from sticking attaches to the face of the blade with the second greatest surface area. The knife attachment to prevent food from sticking attaches to the blade such that the knife attachment to prevent food from sticking presents a non-stick surface as the exterior surface of the blade. The knife attachment to prevent food from sticking further comprises a scraping structure. The scraping structure facilitates the movement of an object, such as a foodstuff, along a horizontal surface.

14 Claims, 4 Drawing Sheets

KNIFE ATTACHMENT TO PREVENT FOOD FROM STICKING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of performing operations including a hand-held cutting tool, more specifically, a hand knife combined with another implement. (B26B11/00)

SUMMARY OF INVENTION

The knife attachment to prevent food from sticking is configured for use with a knife. The knife further comprises a blade, a bolster, and a handle. The bolster attaches the blade to the handle. The knife attachment to prevent food from sticking is a non-stick structure. A first instantiation of the knife attachment to prevent food from sticking attaches to the face of the blade with the greatest surface area. An optional second instantiation of the knife attachment to prevent food from sticking attaches to the face of the blade with the second greatest surface area. The knife attachment to prevent food from sticking attaches to the blade such that the knife attachment to prevent food from sticking presents a non-stick surface as the exterior surface of the blade. The knife attachment to prevent food from sticking further comprises a scraping structure. The scraping structure facilitates the movement of an object, such as a foodstuff, along a horizontal surface.

These together with additional objects, features and advantages of the knife attachment to prevent food from sticking will be readily apparent to those of ordinary skill in the art upon reading the following detailed description of the presently preferred, but nonetheless illustrative, embodiments when taken in conjunction with the accompanying drawings.

In this respect, before explaining the current embodiments of the knife attachment to prevent food from sticking in detail, it is to be understood that the knife attachment to prevent food from sticking is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the knife attachment to prevent food from sticking.

It is therefore important that the claims be regarded as including such equivalent construction insofar as they do not depart from the spirit and scope of the knife attachment to prevent food from sticking. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
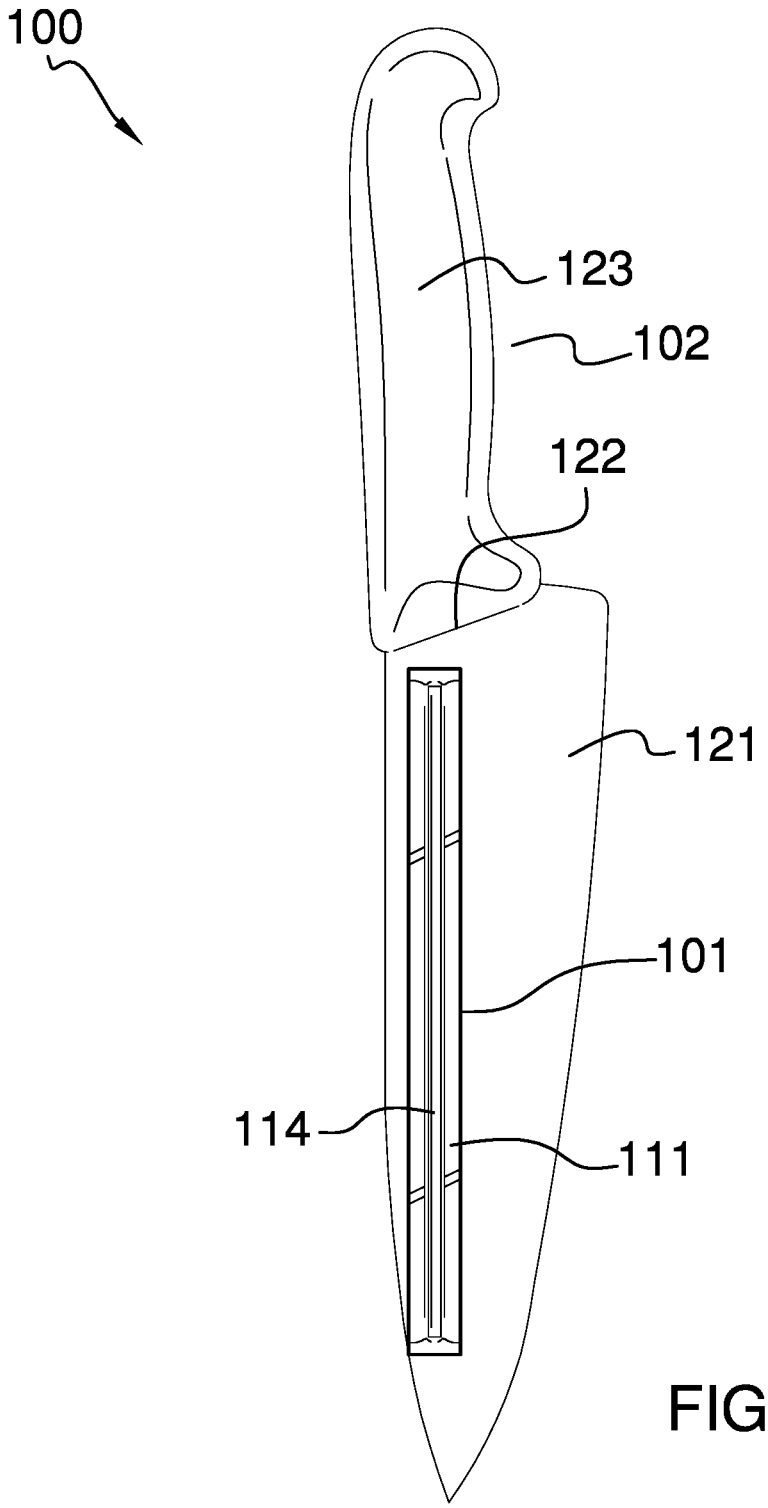
FIG. 1 is an in-use view of an embodiment of the disclosure.
Figure 2:
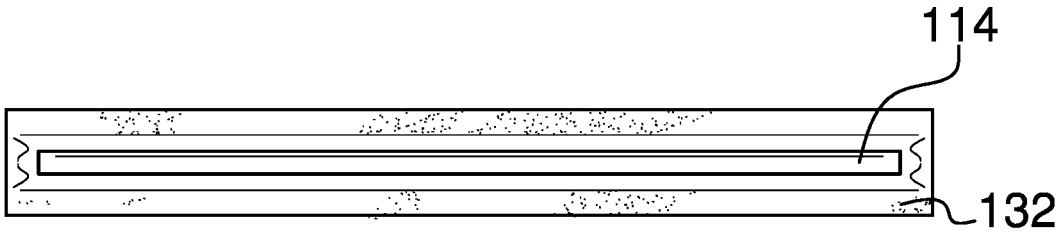
FIG. 2 is a bottom view of an embodiment of the disclosure.
Figure 3:
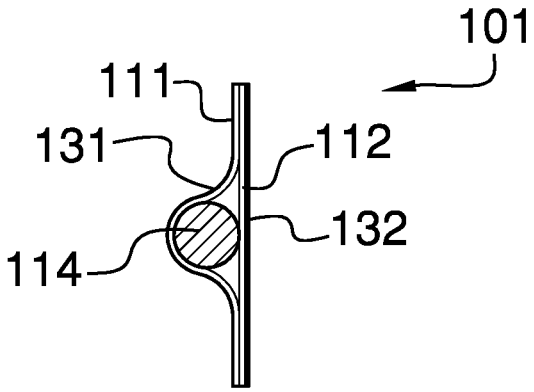
FIG. 3 is a side view of an embodiment of the disclosure.
Figure 4:
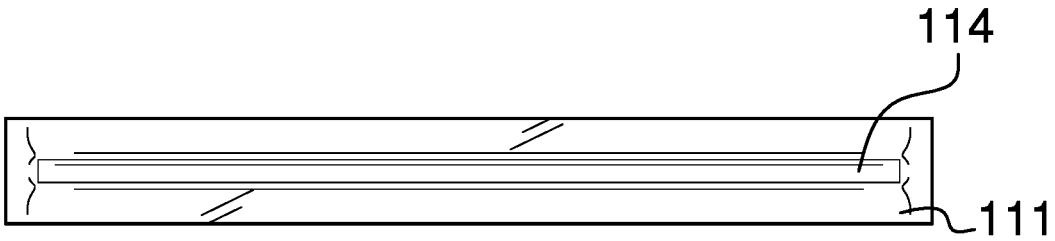
FIG. 4 is a front view of an embodiment of the disclosure.
Figure 5:
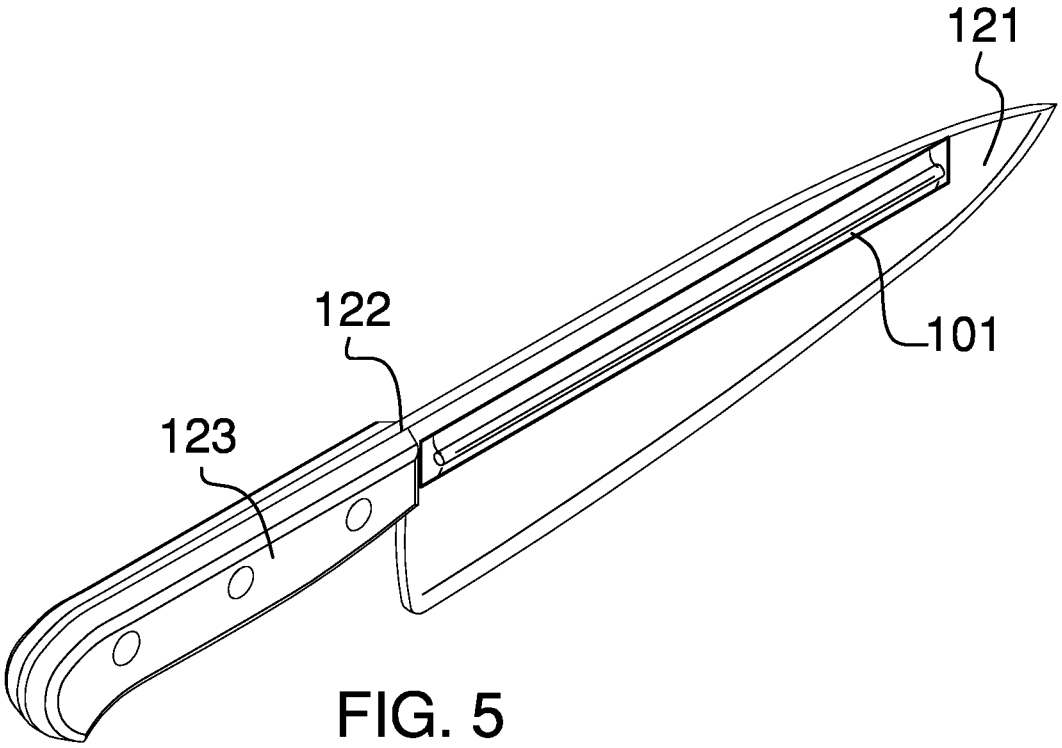
FIG. 5 is a perspective view of an embodiment of the disclosure.
Figure 6:
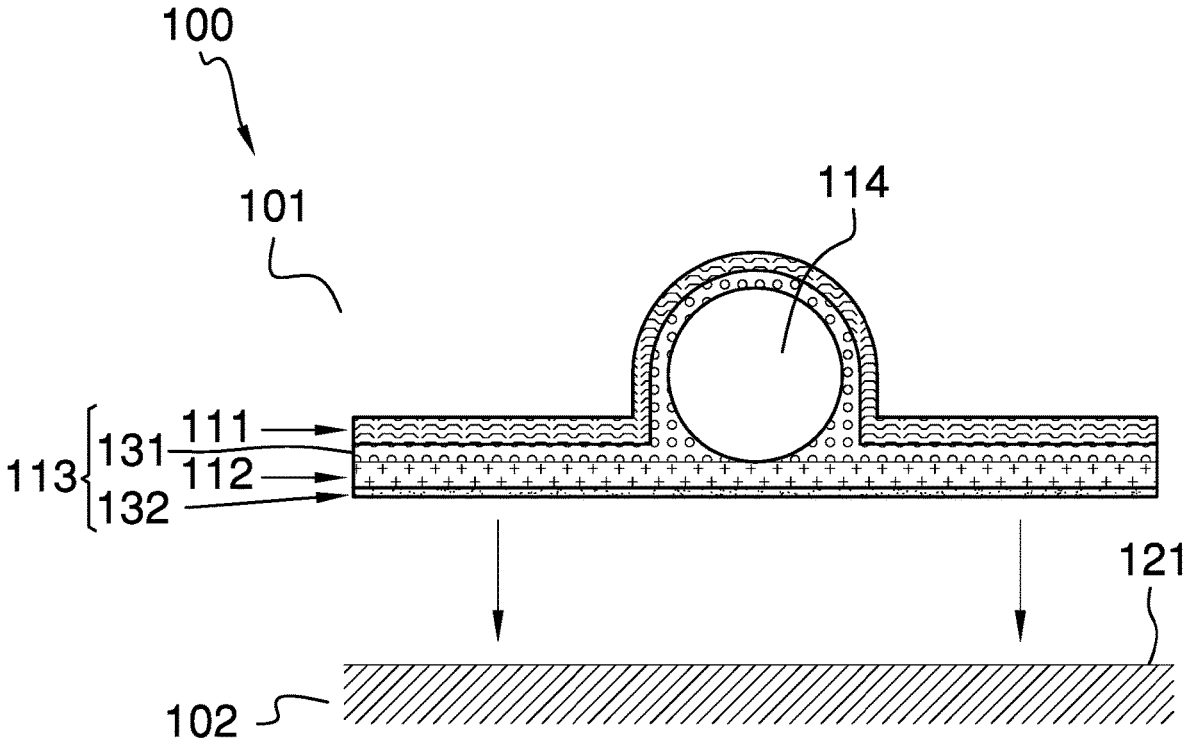
FIG. 6 is a detail view of an embodiment of the disclosure.

Detailed reference will now be made to one or more potential embodiments of the disclosure, which are illustrated in FIGS. 1 through 6.

The knife attachment to prevent food from sticking 100 (hereinafter invention) is configured for use with a knife 102. The knife 102 further comprises a blade 121, a bolster 122, and a handle 123. The bolster 122 attaches the blade 121 to the handle 123. The invention 100 is a non-stick structure 101. A first instantiation of the invention 100 attaches to the face of the blade 121 with the greatest surface area. An optional second instantiation of the invention 100 attaches to the face of the blade 121 with the second greatest surface area. The invention 100 attaches to the blade 121 such that the invention 100 presents a non-stick surface as the exterior surface of the blade 121. The invention 100 further comprises a scraping structure 114. The scraping structure 114 facilitates the movement of an object, such as a foodstuff, along a horizontal surface.

The knife 102 is a cutting tool commonly used to cut a foodstuff. The knife 102 is defined elsewhere in this disclosure. The knife 102 comprises a blade 121, a bolster 122, and a handle 123.

The blade 121 forms the working element of the knife 102. The blade 121 is defined elsewhere in this disclosure. The bolster 122 is a mechanical structure that attaches the blade 121 to the handle 123. The blade 121 is defined elsewhere in this disclosure. The handle 123 is a grip used to manipulate the blade 121 during the cutting of the foodstuff. The handle 123 and grip are defined elsewhere in this disclosure.

The non-stick structure 101 is a composite material structure. The term composite material is defined elsewhere in this disclosure. The non-stick structure 101 is a sheeting structure. The non-stick structure 101 attaches to a face of the blade 121 of the knife 102 selected from the group consisting of: a) the face of the blade 121 with the greatest surface area; and, b) the face of the blade 121 with the second greatest surface area. The non-stick structure 101 applies a non-stick surface that forms an exterior surface for the blade 121 of the knife 102 that prevents a foodstuff from sticking to the blade 121 as the blade 121 cuts through the foodstuff. The non-stick structure 101 further forms a scraping structure 114. The scraping structure 114 is a structure applied to the knife 102 by the non-stick structure 101. The scraping structure 114 is a tool used to move a foodstuff along a horizontal surface. The non-stick structure 101 comprises a non-stick film 111, a backing film 112, a plurality of adhesive layers 113, and a scraping structure 114.

The non-stick film 111 is a plastic sheeting. The non-stick film 111 forms the exterior layer of the non-stick structure 101 when the non-stick structure 101 is properly attached to the blade 121 of the knife 102. The non-stick film 111 is formed from a non-stick material that prevents the foodstuff from sticking to the blade 121 of the knife 102 as the foodstuff is being cut. In the first potential embodiment of the disclosure, the non-stick film 111 is a polymer based sheeting formed from polytetrafluoroethylene (CAS 9002-84-0).

The backing film 112 is a plastic sheeting. The backing film 112 forms the layer of the composite material structure of the non-stick structure 101 positioned between the non-stick film 111 and the blade 121 of the knife 102. The backing film 112 physically attaches the non-stick film 111 to the blade 121.

Each of the plurality of adhesive layers 113 is an adhesive. Each of the plurality of adhesive layers 113 performs a function selected from the group consisting of: a) attaching the backing film 112 to the blade 121 of the knife 102; and, b) attaching the non-stick film 111 to the backing film 112. The plurality of adhesive layers 113 comprises a first adhesive layer 131 and a second adhesive layer 132.

The first adhesive layer 131 is a chemical adhesive. The term adhesive is defined elsewhere in this disclosure. The first adhesive layer 131 is applied as a coat to the surface of the non-stick film 111 that is proximal to the blade 121 of the knife 102. The first adhesive layer 131 attaches the non-stick film 111 to the surface of the backing film 112 that is distal from the blade 121 of the knife 102. The first adhesive layer 131 attaches to the scraping structure 114 such that the first adhesive layer 131 secures the scraping structure 114 between the non-stick film 111 and the backing film 112. The first adhesive layer 131 permanently attaches the non-stick film 111 and the scraping structure 114 to the backing film 112.

The second adhesive layer 132 is a chemical adhesive. The second adhesive layer 132 is a removable adhesive. The removable adhesive is defined elsewhere in this disclosure. The second adhesive layer 132 is a pressure sensitive adhesive. The pressure sensitive adhesive is defined elsewhere in this disclosure. The second adhesive layer 132 removably attaches the non-stick structure 101 to the selected face of the blade of the knife 102. The second adhesive layer 132 attaches the non-stick structure 101 to the selected face of the blade 121 such that the non-stick film 111 forms the exterior surface of the cutting surface of the blade 121 of the knife 102.

The scraping structure 114 is a prism-shaped structure. The scraping structure 114 is a flexible structure. The scraping structure 114 has an inelastic nature. The scraping structure 114 is sandwiched between the non-stick film 111 and the backing film 112. The scraping structure 114 attaches to the selected face of the blade 121 of the knife 102 such that the scraping structure 114 forms a structure that projects away from the selected face of the blade 121. The scraping structure 114 forms a mechanical structure that can be scraped along a horizontal surface such that the knife 102 can be used to move the foodstuff horizontally along a horizontal surface.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Blade: As used in this disclosure, a blade is a term that is used to describe: 1) a wide and flat portion of a structure; or, 2) the cutting edge of a tool.

Bolster: As used in this disclosure, a bolster is the location of a knife where the blade joins the handle.

Coating: As used in this disclosure, a coating refers to a substance that is applied to the exterior surface of an object such that the coating forms a new exterior surface of the object. A coating is commonly said to be formed as a layer. Paint is an example of a common coating material.

Composite: As used in this disclosure, composite refers to a two-dimensional or three-dimensional structure that that is formed from two or more distinctly identifiable sub-structures.

Composite Material: As used in this disclosure, a composite material is a multilayer structure made of two or more joined layers of sheeting materials and coatings.

Copolymer: As used in this disclosure, a copolymer is a polymer formed from two or more repeating molecules (also referred to as monomers).

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Detritus: As used in this disclosure, detritus refers to an accumulation of unwanted material on a surface.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Film: As used in this disclosure, a film is: a) a coating on a surface that has a roughly consistent thickness as measured in the direction that is perpendicular to the surface; or, b) a sheeting that has a roughly consistent thickness as measure in the direction that is perpendicular to the plane formed by the faces of the disk structure of the sheeting.

Flexible: As used in this disclosure, flexible refers to an object or material that will deform when a force is applied to it but that will not necessarily return to its original shape when the deforming force is removed.

Foodstuff: As used in this disclosure, a foodstuff refers to an edible material that is used as food.

Force of Gravity: As used in this disclosure, the force of gravity refers to a vector that indicates the direction of the pull of gravity on an object at or near the surface of the earth.

Forward: As used in this disclosure, forward is term that relates a first object to a second object. When the first object is closer to the bow of a vehicle, the first object is said to be forward of the second object. The term is commonly used on vessels and vehicles. See bow, aft, port, starboard, and stern Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inelastic Nature: As used in this disclosure, an inelastic nature refers to a flexible structure that maintains its new shape after the flexible structure has been deformed.

Instantiation: As used in this disclosure, an instantiation refers to a specific physical object or process that is created using a specification.

Knife: As used in this disclosure, a knife is a bladed tool used to cut objects.

Layer: As used in this disclosure, a layer is a coating or covering on a surface that has a roughly consistent thickness as measured in the direction that is perpendicular to the surface. The terms layered and layering refers to a plurality of layers that are stacked.

Monomer: As used in this disclosure, a monomer refers to a molecular structure that bonds to itself in a repeating manner to form a polymer.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value.

Organic: As used in this disclosure, organic refers to a carbon-based chemical structure. A limited number of carbon-based salts are traditionally considered inorganic chemical structures and are excluded from the study of organic chemistry.

Plastic: As used in this disclosure, plastic refers to a manufactured material that is formed from a structure selected from the group consisting of a polymer or a copolymer. Unless stated otherwise, this disclosure assumes that the plastic is formed from organic monomers.

Polymer: As used in this disclosure, a polymer refers to a molecular chain that comprises multiple repeating units known as monomers. The repeating unit may be an atom or a molecular structure.

Pressure Sensitive Adhesive: As used in this disclosure, a pressure sensitive adhesive is an adhesive that is activated by the application of pressure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Removable Adhesive: As used in this disclosure, a removable adhesive is a commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Roughly: As used in this disclosure, roughly refers to a comparison between two objects. Roughly means that the difference between one or more parameters of the two compared objects are not significantly different.

Scrape: As used in this disclosure, to scrap means to slide a structure along a surface such that detritus is pushed along, and is eventually removed from, the surface.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Slide: As used in this disclosure, slide is a verb that refers to an object that is transported along a surface while in continuous contact with the surface. An object being transported along a surface with wheels cannot be said to be sliding.

Stack: As used in this disclosure, a stack refers to a collection of disk-shaped objects that are stored such that the congruent ends of each of the disk-shaped objects are placed against each other such that the congruent ends are parallel to each other. The term stack often implies that the congruent ends of the disk-shaped objects are horizontally oriented.

Tool: As used in this disclosure, a tool is a device, an apparatus, or an instrument that is used to carry out an activity, operation, or procedure.

Working Element: As used in this disclosure, the working element of a tool is the physical element on the tool that performs the actual activity, operation, or procedure the tool is designed to perform. For example, the cutting edge of a blade is the working element of a knife.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A knife attachment to prevent food from sticking comprising a non-stick structure attachable to a blade of a knife;

wherein the knife attachment to prevent food from sticking attachable to the blade such that the knife attachment to prevent food from sticking presents a non-stick surface as the exterior surface of the blade when the non-stick structure is attached to the blade of the knife;

wherein a scraping structure is affixed to the non-stick structure; wherein the scraping structure facilitates the movement of an object along a surface of the knife;

wherein the non-stick structure is a composite material structure;

wherein the non-stick structure is a sheeting structure;

wherein the scraping structure is a structure applied to the knife by the non-stick structure when the non-stick structure is attached to the blade of the knife;

wherein the non-stick structure comprises a non-stick film, a backing film, a plurality of adhesive layers, and the scraping structure;

wherein the plurality of adhesive layers attach the non-stick film and the scraping structure to the backing film.

2. The knife attachment to prevent food from sticking according to claim 1 wherein the non-stick film is a plastic sheeting;

wherein the non-stick film forms the exterior layer of the non-stick structure when the non-stick structure is attached to the blade of the knife.

3. The knife attachment to prevent food from sticking according to claim 2 wherein the non-stick film is a polymer based sheeting formed from polytetrafluoroethylene.

4. The knife attachment to prevent food from sticking according to claim 3 wherein the backing film physically attaches the non-stick film to the blade when the non-stick structure is attached to the blade of the knife.

5. The knife attachment to prevent food from sticking according to claim 3 wherein each of the plurality of adhesive layers is an adhesive;

wherein each of the plurality of adhesive layers performs a function selected from the group consisting of: a) attaching the backing film to the blade of the knife when the non-stick structure is attached to the blade of the knife; and, b) attaching the non-stick film to the backing film.

6. The knife attachment to prevent food from sticking according to claim 5 wherein the plurality of adhesive layers comprises a first adhesive layer and a second adhesive layer;

wherein the first adhesive layer attaches the non-stick film to the surface of the backing film that is distal from the blade of the knife when the non-stick structure is attached to the blade of the knife;

wherein the second adhesive layer removably attaches the non-stick structure to a selected face of the blade of the knife when the non-stick structure is attached to the blade of the knife.

7. The knife attachment to prevent food from sticking according to claim 6 wherein the first adhesive layer is a chemical adhesive;

wherein the second adhesive layer is a chemical adhesive.

8. The knife attachment to prevent food from sticking according to claim 7 wherein the second adhesive layer is a removable adhesive;

wherein the second adhesive layer is a pressure sensitive adhesive.

9. The knife attachment to prevent food from sticking according to claim 8 wherein the first adhesive layer is applied as a coat to the surface of the non-stick film that is proximal to the blade of the knife when the non-stick structure is attached to the blade of the knife.

10. The knife attachment to prevent food from sticking according to claim 9 wherein the first adhesive layer permanently attaches the non-stick film and the scraping structure to the backing film;

wherein the second adhesive layer attaches the non-stick structure to the selected face of the blade when the non-stick structure is attached to the blade of the knife such that the non-stick film forms the exterior surface of a cutting surface of the blade of the knife.

11. The knife attachment to prevent food from sticking according to claim 10 wherein the scraping structure is a prism-shaped structure;

wherein the scraping structure is a flexible structure;

wherein the scraping structure has an inelastic nature.

12. The knife attachment to prevent food from sticking according to claim 11 wherein the scraping structure is sandwiched between the non-stick film and the backing film.

13. The knife attachment to prevent food from sticking according to claim 12 wherein when the scraping structure attaches to the selected face of the blade of the knife, the scraping structure forms a structure that projects away from the selected face of the blade.

14. The knife attachment to prevent food from sticking according to claim 2 wherein the backing film is a plastic sheeting;

wherein the backing film forms the layer of the composite material structure of the non-stick structure positioned between the non-stick film and the blade of the knife when the non-stick structure is attached to the blade of the knife.

* * * * *